US012532998B2

(12) United States Patent
Park et al.

(10) Patent No.: US 12,532,998 B2
(45) Date of Patent: Jan. 27, 2026

(54) CLEANING DEVICE HAVING VACUUM CLEANER AND DUST COLLECTING STATION

(71) Applicant: Samsung Electronics Co., Ltd., Suwon-si (KR)

(72) Inventors: Dahwe Park, Suwon-si (KR); Norihiko Inoue, London (GB); Thomas Francis Hamilton, London (GB); Marko Plevnik, London (GB); Kangdoo Kim, Suwon-si (KR); Guyong Park, Suwon-si (KR); Sookyoung Park, Suwon-si (KR); Youngsun Shin, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 268 days.

(21) Appl. No.: 17/944,773

(22) Filed: Sep. 14, 2022

(65) Prior Publication Data

US 2023/0157500 A1 May 25, 2023

Related U.S. Application Data

(63) Continuation of application No. PCT/KR2022/013104, filed on Sep. 1, 2022.

(30) Foreign Application Priority Data

Nov. 22, 2021 (KR) ..... 10-2021-0161715

(51) Int. Cl.
*A47L 9/16* (2006.01)
*A47L 9/10* (2006.01)

(52) U.S. Cl.
CPC ..... *A47L 9/1683* (2013.01); *A47L 9/106* (2013.01)

(58) Field of Classification Search
CPC ..... A47L 9/1683; A47L 9/106; A47L 9/2873; A47L 5/26; A47L 9/108; A47L 9/1691;
(Continued)

(56) References Cited

U.S. PATENT DOCUMENTS 11,382,471 B2 7/2022 Kim et al.
11,382,472 B2 7/2022 Kim et al.
(Continued)

FOREIGN PATENT DOCUMENTS

KR 10-2020-0073966 6/2020
KR 10-2020-0074054 A 6/2020
(Continued)

OTHER PUBLICATIONS

Written Opinion Report dated Dec. 5, 2022 issue in PCT Application No. PCT/KR2022/013104.

*Primary Examiner* — David S Posigian
*Assistant Examiner* — Tyler James Mcfarland
(74) *Attorney, Agent, or Firm* — STAAS & HALSEY LLP

(57) ABSTRACT

A cleaning device includes: a vacuum cleaner including a dust collecting container; and a dust collecting station connectible to the dust collecting container to receive the foreign substances collected in the dust collecting container The dust collecting container includes a dust collecting container main body including a first opening and a dust collecting container door configured to open or close the first opening by rotating around a first axis. The dust collecting station includes: a station main body including an accommodation space, a capturing portion including a second opening to intercommunicate with the first opening, and configured to capture the foreign substances, and a pressurizer configured to rotate around a second axis to apply pressure on one side of the dust collecting container door so
(Continued)

that the dust collecting container door rotates around the first axis to be adjacent to the dust collecting container main body.

18 Claims, 17 Drawing Sheets

(58) Field of Classification Search
CPC ..... A47L 9/2868; A47L 9/28; A47L 2201/02; A47L 2201/024
See application file for complete search history.

(56) References Cited

U.S. PATENT DOCUMENTS

| | | | | |
|---|---|---|---|---|
| 2017/0196430 | A1* | 7/2017 | Machida | A47L 7/0047 |
| 2019/0328188 | A1* | 10/2019 | Conrad | A47L 9/1608 |
| 2020/0107685 | A1* | 4/2020 | Tanaka | A47L 9/108 |
| 2020/0405107 | A1 | 12/2020 | Na et al. | |
| 2021/0052121 | A1 | 2/2021 | Kim et al. | |
| 2021/0068603 | A1* | 3/2021 | Cho | A47L 9/106 |
| 2023/0200607 | A1 | 6/2023 | Kim et al. | |
| 2023/0346185 | A1 | 11/2023 | Wie et al. | |

FOREIGN PATENT DOCUMENTS

| | | | | |
|---|---|---|---|---|
| KR | 10-2166773 | B1 | | 10/2020 |
| KR | 10-2021-0000397 | | | 1/2021 |
| KR | 10-2021-0002057 | A | | 1/2021 |
| KR | 10-2021-0019940 | A | | 2/2021 |
| KR | 10-2269531 | | | 6/2021 |
| KR | 10-2021-0128783 | | | 10/2021 |
| KR | 10-2315420 | | | 10/2021 |
| KR | 20210128783 | A | * | 10/2021 |
| KR | 10-2441608 | | | 9/2022 |

* cited by examiner

CLEANING DEVICE HAVING VACUUM CLEANER AND DUST COLLECTING STATION

CROSS-REFERENCE TO RELATED APPLICATION

This application is a continuation application, under 35 U.S.C. § 111(a), of International Patent Application No. PCT/KR2022/013104, filed on Sep. 1, 2022 which claims the benefit of Korean Patent Application No. 10-2021-0161715, filed on Nov. 22, 2021, in the Korean Intellectual Property Office, the entire disclosures of which are incorporated herein by reference as a part of this application.

BACKGROUND

Field

The disclosure relates to a cleaning device including a vacuum cleaner and a dust collecting station, and in particular, to a cleaning device which includes a vacuum cleaner and a dust collecting station and is capable of automatically discharging dust inside the vacuum cleaner.

Description of Related Art

In general, a vacuum cleaner is a device including a fan motor for generating absorptive power and configured to suck foreign substances such as dust, etc. together with air according to the absorptive power generated by the fan motor, and then separate and collect the foreign substances from the sucked air to perform cleaning.

The vacuum cleaner includes a dust collecting container for collecting the foreign substances, and a user may periodically separate the dust collecting container from the vacuum cleaner to discharge the foreign substances collected in the dust collecting container.

A dust collecting station on which the vacuum cleaner is to be docked may be provided, and the foreign substances may be automatically discharged from the dust collecting container in the vacuum cleaner docked on the dust collecting station. When the discharge of the foreign substances to the dust collecting station is completed, the vacuum cleaner may be undocked from the dust collecting station, and a dust collecting container door, which was opened for the discharge of the foreign substances, may be closed again.

SUMMARY

According to an embodiment of the disclosure, a cleaning device includes: a vacuum cleaner including a dust collecting container to collect foreign substances therein; and a dust collecting station connectible to the dust collecting container to receive foreign substances collected in the dust collecting container from the dust collecting container, the dust collecting container includes a dust collecting container main body including a first opening and a dust collecting container door configured to open or close the first opening by rotating around a first axis in the clockwise direction or in the counterclockwise direction, the dust collecting station includes: a station main body including an accommodation space to collect foreign substances therein; a capturing portion formed one side of the station main body, the capturing portion including a second opening to intercommunicate with the first opening of the dust collecting container main body in response to connecting the dust collecting container with the dust collecting station, and configured to capture the foreign substances collected in the dust collecting container; and a pressurizer rotating around a second axis perpendicular to the first axis and to apply pressure on one side of the dust collecting container door so that the dust collecting container door rotates around the first axis in the clockwise direction or in the counterclockwise direction to be adjacent to the dust collecting container main body.

The pressurizer may include: a base portion including a hollow opening and having a shape of a ring; and a stepped portion having a circular segment shape and protruding from one side of the base portion in a direction toward the second axis and extending along an angle in a circumferential direction of the base portion, wherein the hollow opening is arranged to face the second opening, and one side of the stepped portion is arranged to face one side of the dust collecting container door.

In response to closing the first opening by the dust collecting container door, one side of the stepped portion may be arranged to be in contact with one side of the dust collecting container door, and in response to opening the first opening by the dust collecting container door, the one side of the stepped portion may be arranged not to be in contact with the one side of the dust collecting container door.

The cleaning device may further include a first driving motor configured to apply power to the pressurizer to rotate around the second axis.

The cleaning device may further include a locking controller switching a state of the dust collecting container door between a lock state which the locking controller locks the dust collecting container door by applying pressure to a door latch portion arranged at the dust collecting container and an unlock state which the locking controller unlocks the dust collecting container door by releasing the applied pressure.

In response to closing the first opening by the dust collecting container door, and switching to the lock state by the locking controller, one side of the stepped portion may be arranged not to be in contact with one side of the dust collecting container door.

The station main body may further include an accommodating portion to accommodate the locking controller therein, the locking controller is accommodated in the accommodating portion in response to switching to the lock state, and the locking controller protrudes from the accommodating portion in response to switching to the unlock state.

The cleaning device may further include a second driving motor configured to apply power to the locking controller to be protruded from the accommodating portion to be accommodated in the accommodating portion.

The cleaning device may further include an intake device configured to form an intake current so that the foreign substances in the dust collecting container are captured in the capturing portion, wherein, by the intake current, the dust collecting container door is further configured to rotate around the first axis in the clockwise direction or in the counterclockwise direction to open the first opening arranged at the dust collecting container main body.

The cleaning device may further include an elastic member configured to apply elastic force to the dust collecting container door to close the first opening arranged at the dust collecting container main body.

The elastic member may be a torsion spring arranged on the first axis.

The cleaning device may further include a hinge portion connecting the dust collecting container main body to the dust collecting container door, wherein the stepped portion rotates around the second axis to be adjacent to the hinge portion when the dust collecting container door is in an open state to open the first opening, and the stepped portion rotates around the second axis to be apart from the hinge portion when the dust collecting container door is in a close state to close the first opening.

The cleaning device may further include a power transfer member transmitting the power generated by the first driving motor to the pressurizer.

According to another embodiment of the disclosure, a dust collecting station connectible to a dust collecting container of a vacuum cleaner to receive foreign substances collected in the dust collecting container from the dust collecting container, the dust collecting station includes: a station main body including an accommodation space formed therein to store the received foreign substances; a capturing portion formed one side of the station main body, the capturing portion including a second opening to intercommunicate with the first opening of the dust collecting container main body in response to connecting the dust collecting container with the dust collecting station, and configured to capture the foreign substances collected in the dust collecting container; and a pressurizer configured to rotate around a second axis perpendicular to the first axis and applying pressure on one side of the dust collecting container door so that the dust collecting container door rotates around the first axis in the clockwise direction or in the counterclockwise direction to be adjacent to the dust collecting container main body.

The pressurizer may include: a base portion having a ring shape of a ring including a hollow opening; and a stepped portion having a circular segment shape, and protruding from one side of the base portion in a direction of the second axis and extending along an angle in a circumferential direction toward the base portion, the hollow opening is arranged to face the second opening, and one side of the stepped portion is arranged to face one side of the dust collecting container door.

In response to closing the first opening by the dust collecting container door, one side of the stepped portion may be arranged to be in contact with one side of the dust collecting container door, and in response to opening the first opening by the dust collecting container door, the one side of the stepped portion may be arranged not to be in contact with the one side of the dust collecting container door.

The dust collecting station may further include a first driving motor configured to apply power to the pressurizer to rotate around the second axis.

The dust collecting station may further include a locking controller configured to switch the dust collecting container door between a lock state which the locking controller locks the dust collecting container door by applying pressure to a door latch portion arranged at the dust collecting container and an unlock state which the locking controller unlocks the dust collecting container door by releasing the applied pressure.

The station min body may further include an accommodating portion to accommodate the locking controller therein, the locking controller is accommodated in the accommodating portion in response to switching to the lock state, and the locking controller protrudes from the accommodating portion in response to switching to the unlock state.

The dust collecting station may further include a second driving motor configured to apply power to the locking controller to be protruded from the accommodating portion to be accommodated in the accommodating portion.

According to an embodiment of the disclosure, a cleaning device including a vacuum cleaner and a dust collecting station may improve user friendliness by allowing an opened dust collecting container door to be automatically closed when the discharge of foreign substances from a dust collecting container is completed.

According to another embodiment of the disclosure, a cleaning device including a vacuum cleaner and a dust collecting station may enhance design convenience by having an improved structure which facilitates simplification of a design of an opening and closing device configured to automatically open and close a dust collecting container door.

According to an aspect of the disclosure, provided is a cleaning device which includes a vacuum cleaner and a dust collecting station and is capable of automatically closing an opened dust collecting container door when the discharge of foreign substances from a dust collecting container is completed.

According to another aspect of the disclosure, provided is a cleaning device which includes a vacuum cleaner and a dust collecting station and has an improved structure that facilitates simplification of a design of an opening and closing device configured to automatically open and close a dust collecting container door.

DETAILED DESCRIPTION

Figure 1A:
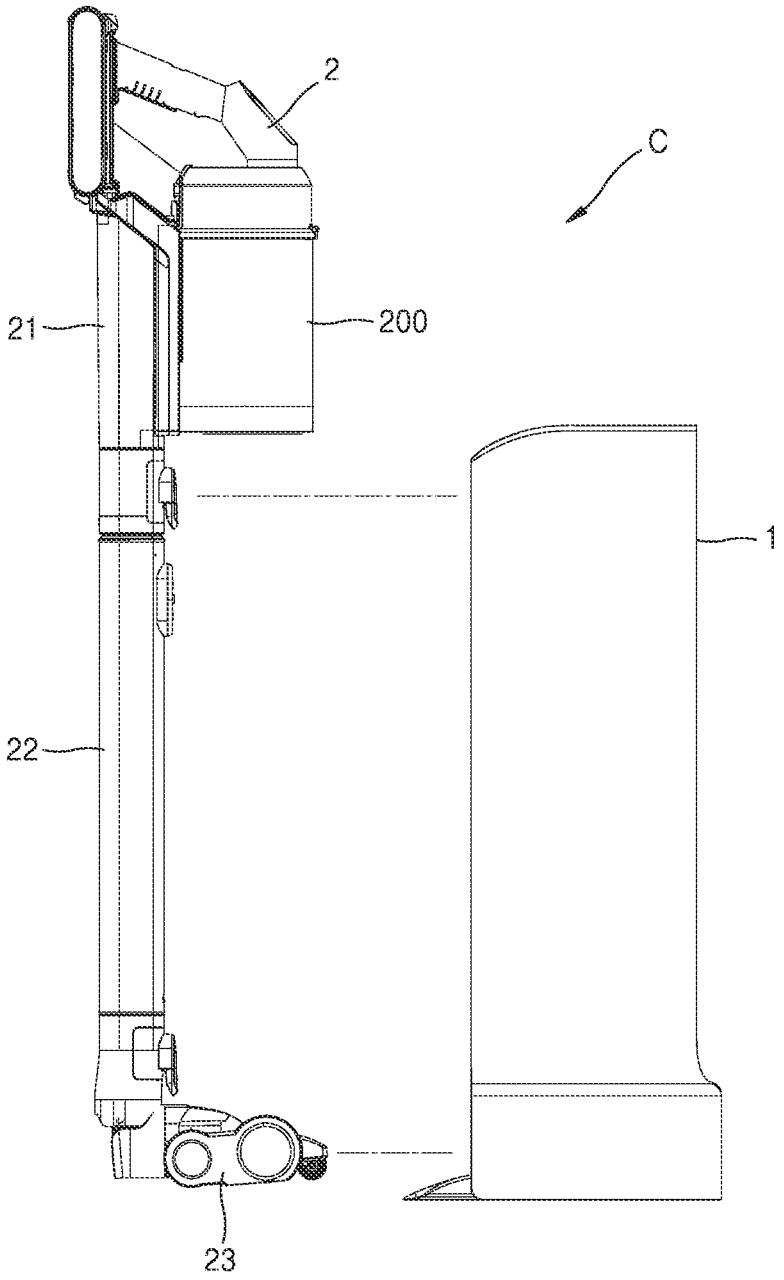
FIG. 1A is a perspective view of a cleaning device including a vacuum cleaner and a dust collecting station separated from each other, according to an embodiment of the disclosure.

Throughout the disclosure, the expression "at least one of a, b or c" indicates only a, only b, only c, both a and b, both a and c, both b and c, all of a, b, and c, or variations thereof.

Hereinafter, components and effects thereof of the disclosure are described in detail with reference to the accompanying drawings.

The terms used in the present specification are now briefly explained, followed by the detailed description of the disclosure.

General terms which are currently used widely have been selected for use in consideration of their functions in embodiments; however, such terms may be changed according to an intention of a person skilled in the art, precedents, advent of new technologies, etc. Furthermore, in certain cases, terms have been arbitrarily selected by the applicant, and in such cases, meanings of the terms will be explained in detail in corresponding descriptions. Accordingly, the terms used in the embodiments of the disclosure should be defined based on their meanings and overall descriptions of the embodiments, not simply by their names.

In the specification, when a portion "includes" a component, another component may be further included, rather than excluding the existence of other components, unless otherwise described.

The terms as "first," "second," etc., are used only to distinguish one component from another, and such components must not be limited by the above terms.

Hereinafter, embodiments of the disclosure will be described in detail with reference to the accompanying drawings so that a person with ordinary skill in the art may easily perform the disclosure. However, the disclosure may be implemented in various different forms and is not limited to embodiments described herein. To clearly describe the disclosure in the drawings, a part irrelevant to the descriptions of the disclosure is omitted in the drawings, and throughout the specification, like reference numerals denote like components.

The terms such as "upper," "lower," "forward and backward directions" used in the descriptions below are defined based on the drawings, and thus, shapes and positions of each component are not limited by such terms.

Hereinafter, embodiments of the disclosure are described in detail with reference to the accompanying drawings.

Figure 1B:
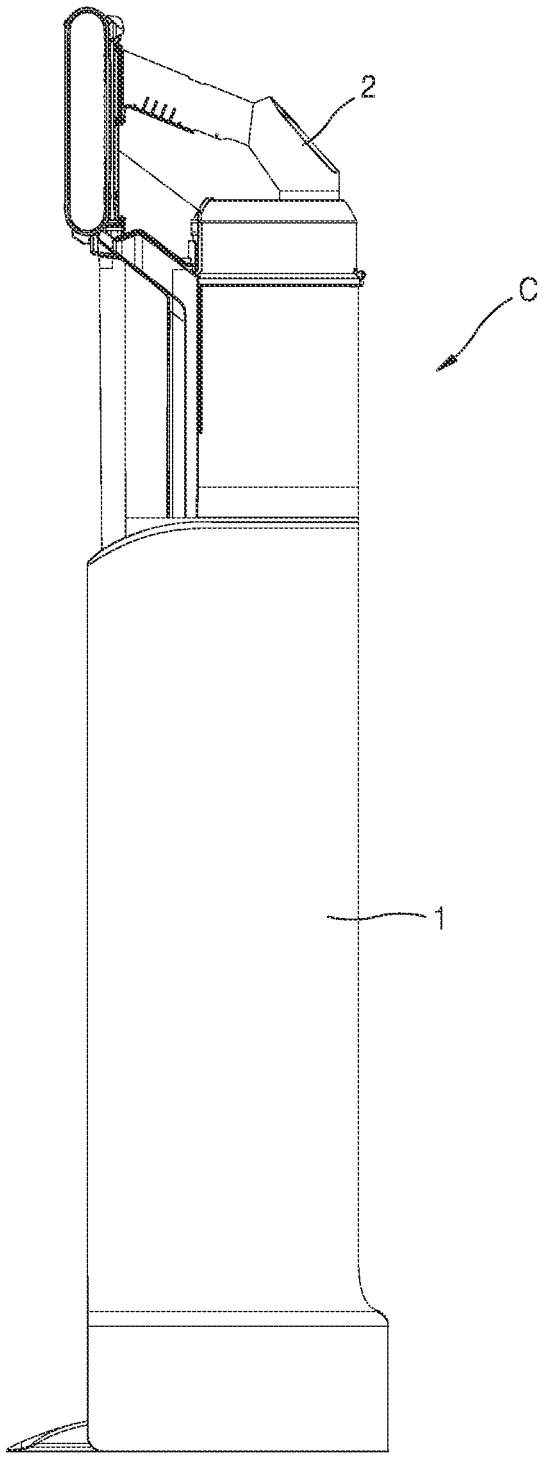
FIG. 1B is a perspective view of a cleaning device including a vacuum cleaner docked on a dust collecting station.

FIG. 1A is a perspective view of a cleaning device with a vacuum cleaner and a dust collecting station separated from each other, according to an embodiment of the disclosure. FIG. 1B is a perspective view of a cleaning device with a vacuum cleaner docked on a dust collecting station.

With reference to FIGS. 1A and 1B, a cleaning device C according to an embodiment may include a dust collecting station 1 and a vacuum cleaner 2.

The vacuum cleaner 2 according to an embodiment of the disclosure may include a cleaner main body 21, an extension tube 22 removably coupled to the cleaner main body 21, an intake unit 23 removably coupled to the extension tube 22, and a dust collecting container 200 coupled to the cleaner main body 21.

The cleaner main body 21 may include an intake motor (not shown) generating absorptive power required to suck foreign substances on a target surface to be cleaned, and may be coupled to the dust collecting container 200 in which the foreign substances sucked in from the target surface are accommodated.

The dust collecting container 200 may be arranged higher than the intake motor in an upstream of air flow and configured to filter out and collect dust or dirt in the air which has flowed in through the main intake unit 23. The dust collecting container 200 according to an embodiment may be removably coupled to the cleaner main body 21.

The dust collecting station 1 according to an embodiment may be configured to be able to house or hold the vacuum cleaner 2. For example, a battery of the vacuum cleaner 2 may be charged while the vacuum cleaner 2 is docked on the dust collecting station 1 as illustrated in FIG. 1B. Furthermore, when the vacuum cleaner 2 is docked on the dust collecting station 1, the dust collecting station 1 according to an embodiment may automatically discharge the dust collected inside the dust collecting container 200 to improve user friendliness. The dust collecting station 1 according to an embodiment may only automatically discharge the dust collected in the dust collecting container 200 without charging the vacuum cleaner 2.

When the vacuum cleaner 2 is docked on the dust collecting station 1 according to an embodiment of the disclosure, a user may input a signal to an input portion (not shown) to discharge the foreign substances collected in the dust collecting container 200 to the dust collecting station 1. At this time, the dust collecting station 1 connected to the dust collecting container 200 may discharge from the dust collecting container 200 the foreign substances collected in the dust collecting container 200 by using an intake device 120 (see FIG. 3C).

According to an embodiment of the disclosure, a dust collecting container door 220 (see FIG. 2A) may be opened to discharge the foreign substances collected in the dust collecting container 200. Moreover, when the discharge of the foreign substances collected in the dust collecting container 200 is completed, the dust collecting container door 220 (see FIG. 2A) may be closed again. In related arts, a user needs to endure the inconvenience of manually opening and closing the dust collecting container door 220 (see FIG. 2A) to discharge the foreign substances collected in the dust collecting container 200. According to an embodiment of the disclosure, the dust collecting container door 220 (see FIG. 2A) may be automatically opened and closed to discharge the foreign substances collected in the dust collecting container 200. Hereinafter, the technical feature of automatically opening and closing the dust collecting container door 220 (see FIG. 2A) in the process of discharging the foreign substances collected in the dust collecting container 200 is described in more detail below.

Figure 2A:
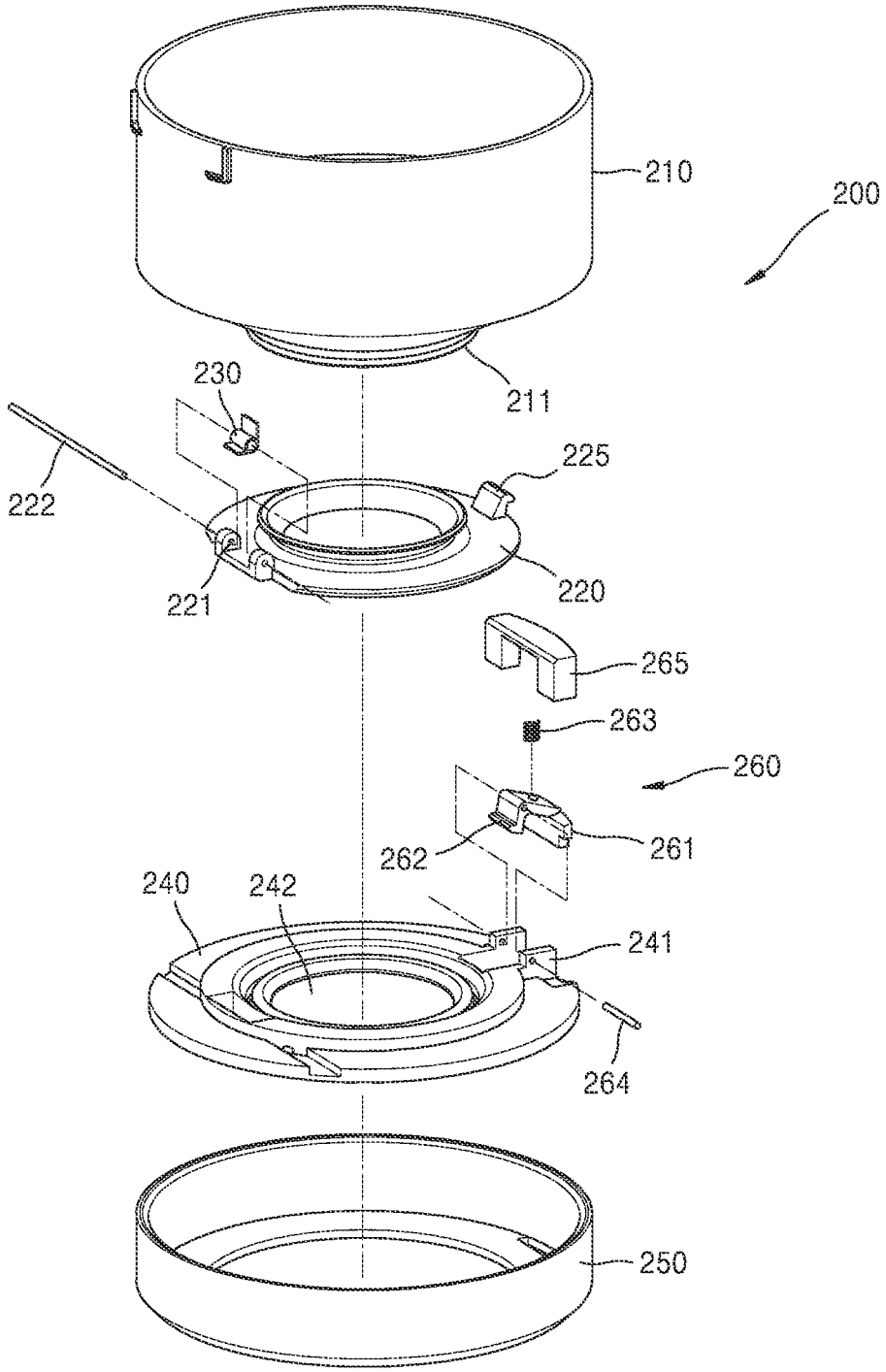
FIG. 2A is an exploded perspective view of a dust collecting container according to an embodiment of the disclosure.
Figure 2B:
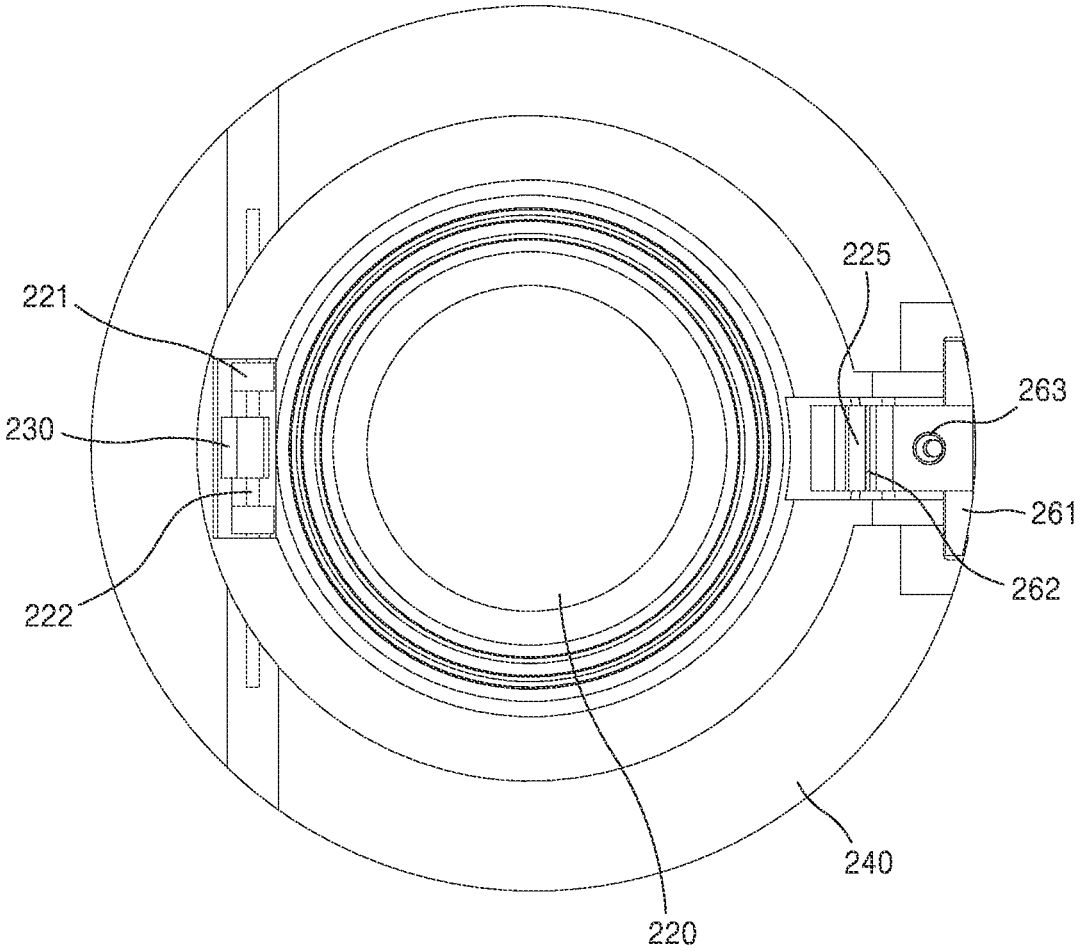
FIG. 2B is a plan view of a dust collecting container according to an embodiment of the disclosure.

FIG. 2A is an exploded perspective view of a dust collecting container according to an embodiment. FIG. 2B is a plan view of a dust collecting container according to an embodiment.

With reference to FIGS. 2A and 2B, the dust collecting container 200 according to an embodiment may include a dust collecting container main body 210, the dust collecting container door 220, a first elastic member 230, a dust collecting container door supporting portion 240, an exterior member 250, and a door latch portion 260. The dust collecting container main body 210 according to an embodiment may be an accommodation member with a chamber to accommodate collected foreign substances. For example, the dust collecting container main body 210 may include a first opening 211 which may be opened and closed by the dust collecting container door 220. When the dust collecting container door 220 is opened, the foreign substances collected in the dust collecting container main body 210 may be discharged to the dust collecting station 1 through the first opening 211.

The dust collecting container door 220 may open and close the first opening 211 provided at the dust collecting container main body 210. The dust collecting container door 220 according to an embodiment may be connected to the dust collecting container main body 210 by using a hinge portion 221. Accordingly, the dust collecting container door 220 according to an embodiment may rotate around a first axis 222 in the clockwise direction or in the counterclockwise direction with respect to the dust collecting container main body 210.

For example, when an open state where the first opening 211 is opened by the dust collecting container door 220 is switched to a close state where the first opening 211 is closed by the dust collecting container door 220, the dust collecting container door 220 may rotate around the first axis 222 in any one direction from the clockwise direction or the counterclockwise direction, for example, in a first direction. Furthermore, when the close state where the first opening 211 is closed by the dust collecting container door 220 is switched to the open state where the first opening 211 is opened by the dust collecting container door 220, the dust collecting container door 220 may rotate around the first axis 222 in any one direction from the clockwise direction or the counterclockwise direction, for example, in a second direction which is opposite to the first direction.

The elastic member 230 may apply elastic force so that the dust collecting container door 220 closes the first opening 211 provided at the dust collecting container main body 210. For example, the elastic member 230 may apply elastic force so that the dust collecting container door 220 rotates around the first axis 222 in the first direction. For example, the elastic member 230 may be a torsion spring arranged on the first axis 222. The elastic member 230 may apply elastic force in the first direction so that the state of the dust collecting container door 220 is switched from the open state to the close state. Accordingly, when the discharge of the foreign substances collected in the dust collecting container main body 210 is completed, the state of the dust collecting container door 220 may be automatically switched from the open state to the close state. However, the disclosure is not limited thereto, and the elastic member 230 may not be provided for user's convenience in design.

The dust collecting container door supporting portion 240 may be a support member fixed to the dust collecting container main body 210 and supporting the dust collecting container door 220. For example, the dust collecting container door supporting portion 240 may be arranged to be fixed to the dust collecting container main body 210. Furthermore, the dust collecting container door supporting portion 240 may support the hinge portion 221 arranged to be fixed to the dust collecting container door 220. Accordingly, the dust collecting container door 220 may be connected to the dust collecting container main body 210 by using the hinge portion 221.

The dust collecting container door supporting portion 240 according to an embodiment may have a shape of a ring having a hollow opening 242. The hollow opening 242 may be arranged to face the first opening 211 provided at the dust collecting container main body 210. Accordingly, the hollow opening 242 may form a passage through which the foreign substances collected in the dust collecting container main body 210 are discharged.

The exterior member 250 may be a protection member to protect the dust collecting container door 220 and the dust collecting container door supporting portion 240 from the outside. For example, the exterior member 250 may have a shape of a ring having a hollow opening. The dust collecting container door 220 and the dust collecting container door supporting portion 240 may be accommodated in the hollow opening. The exterior member 250 may not be arranged for user's convenience in design.

The door latch portion 260 may be engaged with a first latch portion 225 arranged at the dust collecting container door 220 to lock or unlock the dust collecting container door 220. For example, the door latch portion 260 may include a rotational force applying portion 261, a second latch portion 262 to be engaged with the first latch portion 225, an elastic portion 263, and a rotation shaft 264. The rotational force applying portion 261 according to an embodiment may be pressurized by a locking controller 300 (see FIG. 3C) to be described later and rotate around the rotation shaft 264. At this time, the rotation shaft 264 may be supported by a dust collecting container door hinge portion 241.

The second latch portion 262 according to an embodiment may by supported by the rotational force applying portion 261, and the rotational force may be applied to the second latch portion 262 by the rotational force applying portion 261. Accordingly, the rotational force applying portion 261 may apply rotational force to the second latch portion 262, and the second latch portion 262 may rotate around the rotation shaft 264. For example, as the second latch portion 262 rotates around the rotation shaft 264, the second latch portion 262 may be engaged with the first latch portion 225 and be locked, or may be released from the first latch portion 225.

The elastic portion 263 according to an embodiment may face the locking controller 300 (see FIG. 3C) to be described later, with the rotational force applying portion 261 arranged therebetween. For example, when the locking controller 300 is raised and thus the rotational force applying portion 261 is raised as well, the elastic portion 263 may be in contact with an elastic portion supporting portion 265 and compressed. Then, when the locking controller 300 descends, the elastic portion 263 may be expanded. At this time, the rotational force applying portion 261 supported by the elastic portion 263 may descend in one direction (Z direction). The second latch portion 262 supported by the rotational force applying portion 261 may rotate around the rotation shaft 264 in the clockwise direction. In this manner, the second latch portion 262 may be engaged with the first latch portion 225 and switched to the lock state.

Figure 3A:
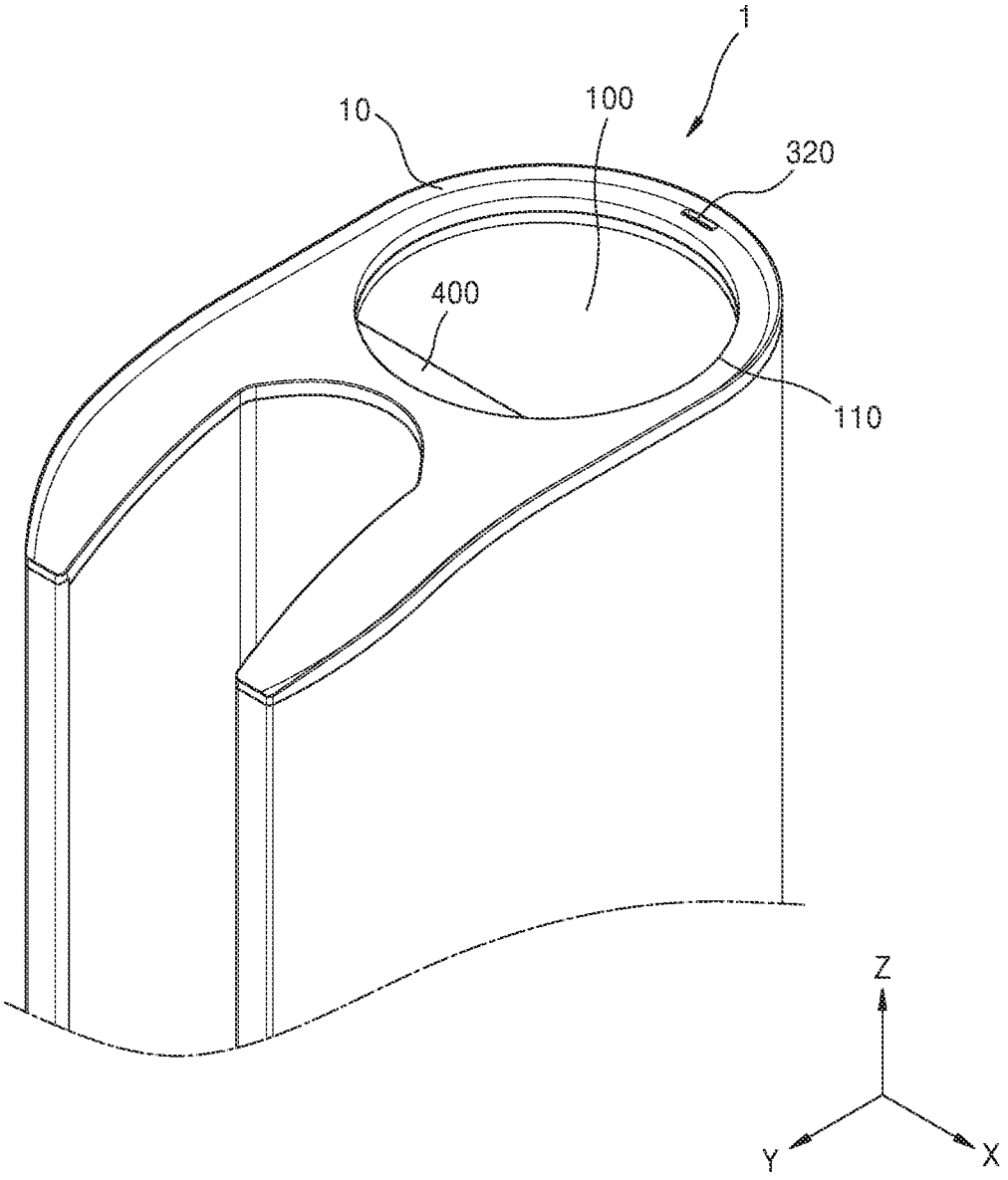
FIG. 3A is a perspective view of a dust collecting station according to an embodiment of the disclosure.
Figure 3B:
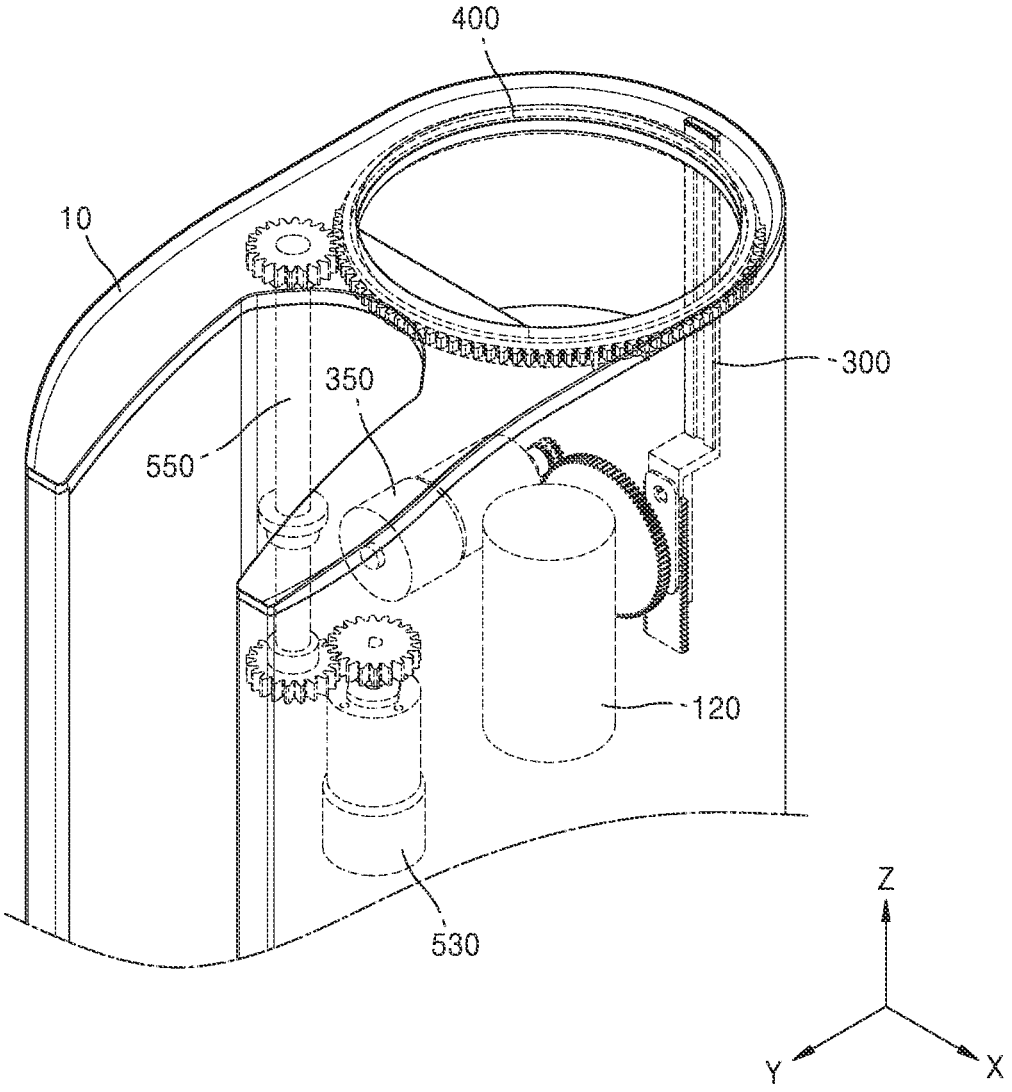
FIG. 3B is a projected perspective view of a dust collecting station according to an embodiment of the disclosure.
Figure 3C:
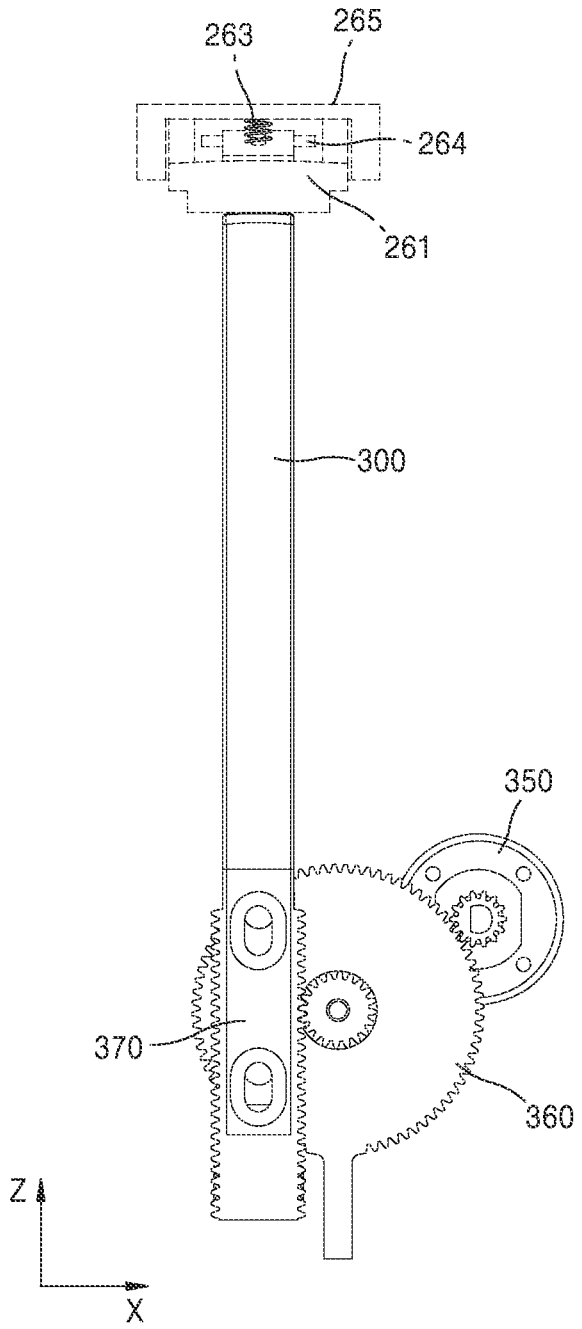
FIG. 3C is a perspective view of a locking controller according to an embodiment of the disclosure.
Figure 3D:
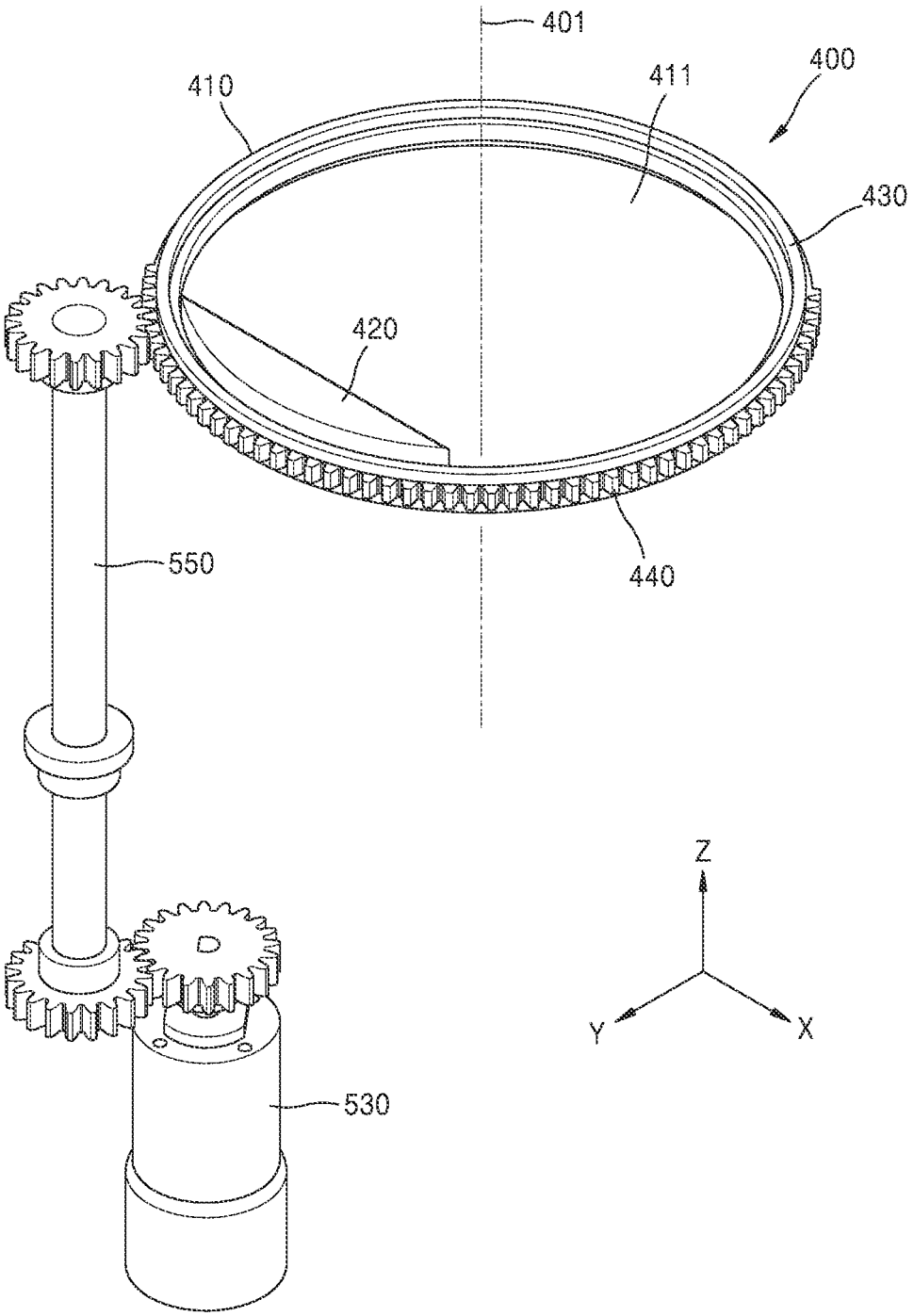
FIG. 3D is a perspective view of a pressurizer according to an embodiment of the disclosure.

FIG. 3A is a perspective view of a dust collecting station according to an embodiment. FIG. 3B is a projected perspective view of a dust collecting station according to an embodiment. FIG. 3C is a perspective view of a locking controller according to an embodiment. FIG. 3D is a perspective view of a pressurizer according to an embodiment.

With reference to FIGS. 2A, 3A, and 3B, the dust collecting station 1 according to an embodiment may include a station main body 10 including an accommodation space, a capturing portion 100 arranged in the accommodation space, an intake device 120 forming an intake current so that the foreign substances in the dust collecting container 200 are captured in the capturing portion 100, the locking controller 300 switching the state of the dust collecting container door 220 between the lock state and the unlock state, and a pressurizer 400 applying pressure on one side of the dust collecting container door 220.

The station main body 10 according to an embodiment may be a housing member capable of accommodating the capturing portion 100, the locking controller 300, and the pressurizer 400 to be described later. For example, the locking controller 300 may protrude from or be accommodated in the station main body 10, and the pressurizer 400 may be accommodated to be rotatable around a second axis 401 perpendicular to the first axis 222 in the station main body 10. For example, an accommodating portion 320 accommodating the locking controller 300 may be arranged at the station main body 10. Accordingly, the locking controller 300 may protrude from or be accommodated in the accommodating portion 320 according to whether the dust collecting container door 220 is opened or closed.

Moreover, for example, the pressurizer 400 may be arranged to be rotatable around the second axis 401 in the clockwise direction or in the counterclockwise direction at the station main body 10. Accordingly, the pressurizer 400 may rotate around the second axis 401 in the clockwise direction on in the counterclockwise direction according to whether the dust collecting container door 220 is opened or closed.

The capturing portion 100 may be arranged in an accommodation space included in the station main body 10. For example, when the dust collecting container door 220 is opened, the capturing portion 100 may include a second opening 110 intercommunicating with the first opening 211 provided at the dust collecting container main body 210. Accordingly, when the dust collecting container door 220 is opened, an intake passage connected to the capturing portion 100 from the dust collecting container main body 210 may be formed. When an intake current is formed by the intake device 120 to be described later, the foreign substances collected in the dust collecting container main body 210 may be captured in the capturing portion 100. According to an embodiment of the disclosure, the capturing portion 100 may be a first capturing portion, and a second capturing portion including a filter through which air can pass but dust cannot may be further arranged.

The intake device 120 may form an intake current between the dust collecting container main body 210 and the capturing portion 100. For example, the intake device 120 may include an intake fan (not shown). According to an embodiment of the disclosure, the intake device 120 may form the intake current between the dust collecting container main body 210 and the capturing portion 100 and move the foreign substances collected in the dust collecting container main body 210 to the capturing portion 100. Moreover, the state of the dust collecting container door 220 may be switched from the close state to the open state by the intake current formed by the intake device 120. For example, by the intake current formed by using the intake device 120, the dust collecting container door 220 may rotate around the first axis 222 in one direction, for example, in the second direction to open the first opening 211 provided at the dust collecting container main body 210.

With reference to FIGS. 2A and 3C, the locking controller 300 may apply pressure on the door latch portion 260 arranged at the dust collecting container 200 or release the pressure to switch the state of the dust collecting container door 220 between the lock state and the unlock state. For example, the locking controller 300 may be arranged to be movable in one direction (Z direction). As illustrated in FIG. 3C, a second driving motor 350 may generate power so that the locking controller 300 is movable in one direction (Z direction), for example, the locking controller 300 protrudes from or is accommodated in the accommodating portion 320. The power generated by the second driving motor 350 may be transmitted to the locking controller 300 through a power transfer portion, for example, a 2-1 power transfer gear 360 by using a 2-2 power transfer gear 370. When the locking controller 300 is accommodated in or protrudes from the accommodating portion 320, the state of the dust collecting container door 220 may be switched between the lock state and the unlock state.

For example, when the locking controller 300 moves forward in one direction to protrude from the accommodating portion 320, the state of the dust collecting container door 220 may be switched from the lock state to the unlock state. At this time, the locking controller 300 may apply pressure on the rotational force applying portion 261 provided at the door latch portion 260. Accordingly, the rotational force applying portion 261 may be raised in one direction (Z direction). The second latch portion 262 supported by the rotational force applying portion 261 may rotate around the rotation shaft 264 in the clockwise direction or in the counterclockwise direction, and the locking between the second latch portion 262 and the first latch portion 225 may be released. This will be described in more detail with reference to FIG. 5A.

When the locking controller 300 moves forward in one direction to be accommodated in the accommodating portion 320, the state of the dust collecting container door 220 may be switched from the unlock state to the lock state. At this time, the locking controller 300 may release pressure applied on the rotational force applying portion 261 provided at the door latch portion 260. The elastic portion 263 may be expanded and simultaneously apply elastic force to the rotational force applying portion 261. Accordingly, the rotational force applying portion 261 may descend in one direction (Z direction) and return to the original state. The second latch portion 262 supported by the rotational force applying portion 261 may rotate around the rotation shaft 264 in the clockwise direction or in the counterclockwise direction and be engaged with the first latch portion 225. This will be described in more detail with reference to FIG. 8.

With reference to FIGS. 2A and 3D, the pressurizer 400 may apply pressure on one side of the dust collecting container door 220 so that the dust collecting container door 220 closes the first opening 211 of the dust collecting container main body 210, for example, the dust collecting container door 220 rotates around the first axis 222 in the clockwise direction or in the counterclockwise direction to be adjacent to the dust collecting container main body 210. For example, when the state of the dust collecting container door 220 is switched to the close state from the open state, the elastic member 230 illustrated in FIG. 2A may apply elastic force so that the state of the dust collecting container door 220 is switched from the open state to the close state. At this time, a gasket to improve sealing performance may be arranged at a circumferential portion of the first opening 211 provided at the dust collecting container main body 210.

Accordingly, when the state of the dust collecting container door 220 is switched from the open state to the close state, it may be difficult for the dust collecting container door 220 to completely block the first opening 211. The pressurizer 400 according to an embodiment may apply additional pressure on one side of the dust collecting container door 220 in one direction in which the dust collecting container door 220 adjoins the dust collecting container main body 210 to close the first opening 211. However, the disclosure is not limited thereto, and the elastic member 230 illustrated in FIG. 2A may apply elastic force so that the state of the dust collecting container door 220 is switched from the close state to the open state. For example, when the elastic member 230 applies elastic force to switch the state of the dust collecting container door 220 from the close state to the open state, a user may more easily open the dust collecting container door 220, which leads to improved user friendliness. At this time, pressure may be applied to the dust collecting container door 220 so that the state thereof is switched from the open state to the close state by the pressurizer 400 described below.

For example, the pressurizer 400 may include a base portion 410 having a shape of a ring with a hollow opening, a stepped portion 420 protruding from the base portion 410 in a direction of the second axis 401, a guide portion 430 and a gear portion 440. The pressurizer 400 may be arranged to be rotatable around the second axis 401 perpendicular to the first axis 222 in the clockwise direction or in the counterclockwise direction.

According to an embodiment of the disclosure, the base portion 410 may have a shape of a ring including a hollow opening 411. For example, the base portion 410 may be supported to be rotatable in the direction of the second axis 401 with respect to the station main body 10.

The stepped portion 420 may protrude from the base portion 410 in the direction of the second axis 401. The stepped portion 420 according to an embodiment may extend at a certain angle in a circumferential direction of the base portion 410, for example, at an angle less than or equal to 120° in the circumferential direction of the base portion 410. For example, when the pressurizer 400 applies pressure on one side of the dust collecting container door 220, one side of the stepped portion 420 may be arranged to face one side of the dust collecting container door 220.

The guide portion 430 may guide a rotation passage to facilitate rotation in the direction of the second axis 401 with respect to the station main body 10. For example, the guide portion 430 may have a shape of a guide extending in the circumferential direction of the base portion 410. The guide portion 430 may be arranged to be coupled to a guide groove formed at the station main body 10.

The gear portion 440 may receive power generated from a first driving motor 530. For example, the gear portion 440 may extend in the circumferential direction of the base portion 410. The gear portion 440 may be arranged not to overlap the guide portion 430. The gear portion 440 according to an embodiment may be connected to the first driving motor 530 by using a power transfer member 550 transmitting power generated by the first driving motor 530 to the pressurizer 400.

For example, the first driving motor 530 may generate power so that the pressurizer 400 may rotate around the second axis 401 in the clockwise direction or in the counterclockwise direction. In the disclosure, the first driving motor 530 and the second driving motor 350 are provided to generate the power required by the locking controller 300 and the pressurizer 400; however, the disclosure is not limited thereto. There may be one driving motor generating the power required by locking controller 300 and the pressurizer 400, when necessary for design.

According to an embodiment of the disclosure, as the pressurizer 400 is arranged to be rotatable around the second axis 401 in the clockwise direction or in the counterclockwise direction, one side of the stepped portion 420 may be arranged to be or not to be in contact with one side of the dust collecting container door 220. For example, when the dust collecting container door 220 closes the first opening 211, one side of the stepped portion 420 may be arranged to be in contact with one side of the dust collecting container door 220. When the dust collecting container door 220 opens the first opening 211, one side of the stepped portion 420 may be arranged not to be in contact with one side of the dust collecting container door 220. Hereinafter, a series of processes of automatically opening and closing the dust collecting container door 220 according to an embodiment is described with reference to FIGS. 4A to 9B.

Figure 4A:
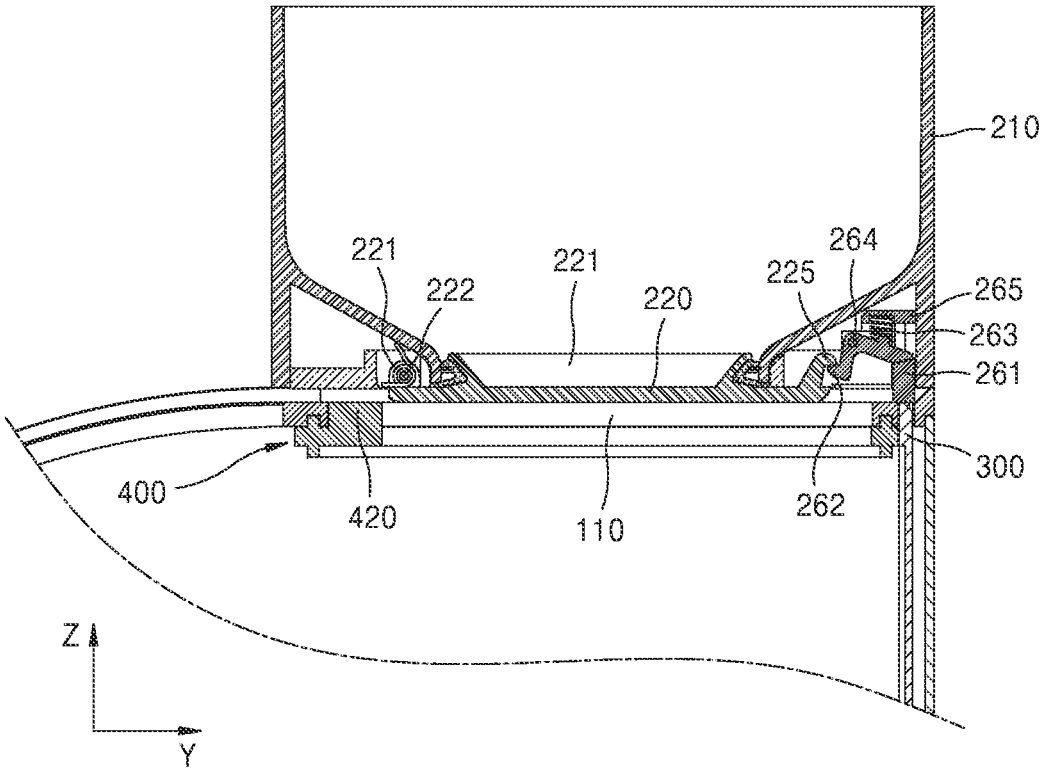
FIG. 4A is a partial cross-sectional view of a cleaning device in a state where a dust collecting container door has closed a first opening, according to an embodiment of the disclosure.
Figure 4B:
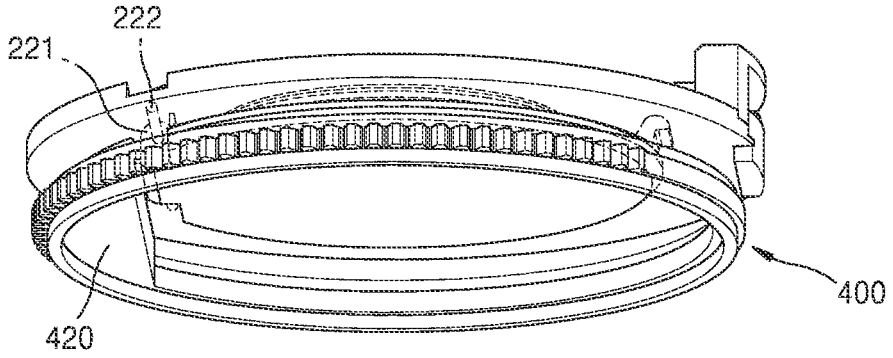
FIG. 4B is a perspective view of a pressurizer and a dust collecting container door according to an embodiment of the disclosure.

FIG. 4A is a partial cross-sectional view of a cleaning device in a state where a dust collecting container door has closed a first opening according to an embodiment. FIG. 4B is a perspective view of a pressurizer and a dust collecting container door according to an embodiment.

With reference to FIGS. 1B and 4A, when the vacuum cleaner 2 is docked on the dust collecting station 1, the dust collecting container door 220 closing the first opening 211 of the dust collecting container main body 210 may be arranged to face the second opening 110 provided at the capturing portion 100.

Moreover, the rotational force applying portion 261 provided at the door latch portion 260 may be arranged to face the locking controller 300. At this time, the locking controller 300 may be accommodate in the accommodating portion 320 illustrated in FIG. 3A. Accordingly, the mutual locking between the first latch portion 225 and the second latch portion 262 may be maintained. Moreover, the dust collecting container door 220 may not rotate around the first axis 222 and remain in the close state.

Furthermore, when the dust collecting container door 220 closes the first opening 211, and the mutual locking between the first latch portion 225 and the second latch portion 262 is maintained, one side of the stepped portion 420 included in the pressurizer 400 may be arranged not to be in contact with one side of the dust collecting container door 220 as illustrated in FIG. 4B. For example, the stepped portion 420 may be arranged under the hinge portion 221. Accordingly, the pressurizer 400 may not apply unnecessary pressure on one side of the dust collecting container door 220.

Figure 5A:
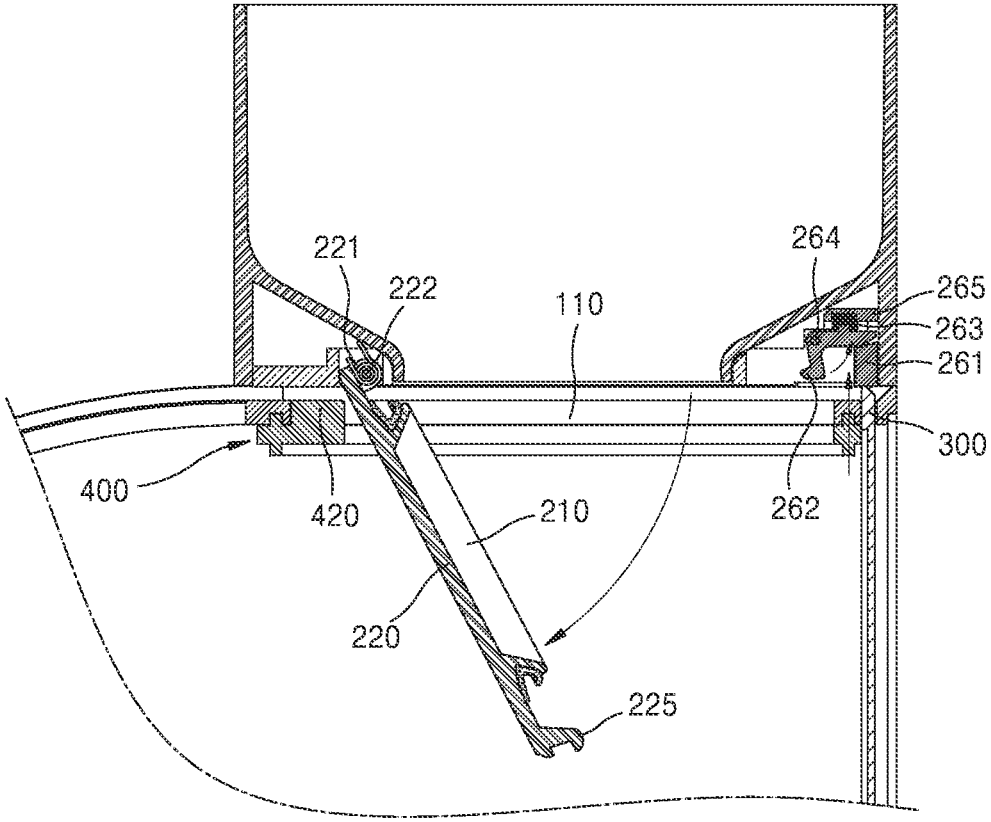
FIG. 5A is a partial cross-sectional view of a cleaning device in a state where a dust collecting container door has opened a first opening, according to an embodiment of the disclosure.
Figure 5B:
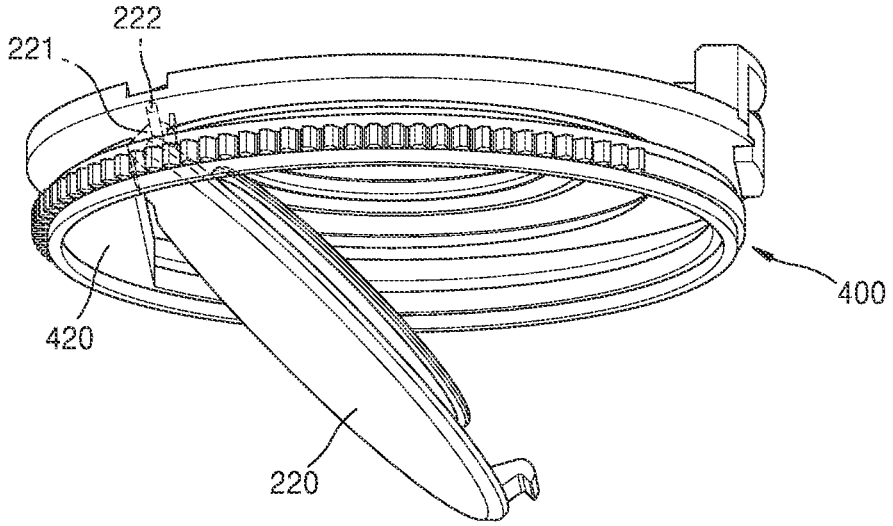
FIG. 5B is a perspective view of a pressurizer and a dust collecting container door according to an embodiment of the disclosure.

FIG. 5A is a partial cross-sectional view of a cleaning device in a state where a dust collecting container door has opened a first opening according to an embodiment. FIG. 5B is a perspective view of a pressurizer and a dust collecting container door according to an embodiment.

With reference to FIGS. 3C and 5A, when a signal to switch the state of the dust collecting container door 220 from the close state to the open state is input from an input portion (not shown) according to an embodiment of the disclosure, a processor (not shown) may apply a control signal to the second driving motor 350 to generate power. For example, the power generated by the second driving motor 350 may be transmitted to the 2-2 power transfer gear 370 through the 2-1 power transfer gear 360. For example, the 2-2 power transfer gear 370 may be provided as a rack gear. Accordingly, the rotational force generated by the second driving motor 350 may be converted into power generating a straight-line motion in one direction (Z direction). The power transmitted to the 2-2 power transfer gear 370 may be transmitted to the locking controller 300 connected to the 2-2 power transfer gear 370. Accordingly, the locking controller 300 may be raised in one direction (Z direction).

When the locking controller 300 which has received the power is raised in one direction (Z direction), the rotational force applying portion 261 may also be raised in one direction (Z direction). Accordingly, the second latch portion 262 supported by the rotational force applying portion 261 may rotate around the rotation shaft 264 in the counterclockwise direction. Then, the locking between the first latch portion 225 and the second latch portion 262 may be released. At this time, one side of the stepped portion 420 included in the pressurizer 400 may be arranged not to be in contact with one side of the dust collecting container door 220 as illustrated in FIG. 5B. For example, the stepped portion 420 may be arranged under the hinge portion 221.

As illustrated in FIGS. 5A and 5B, as the locking between the first latch portion 225 and the second latch portion 262 is released and one side of the stepped portion 420 included in the pressurizer 400 is arranged not to be in contact with one side of the dust collecting container door 220, the dust collecting container door 220 may rotate around the first axis 222 and be opened. For example, by the intake current generated by the intake device 120, the dust collecting container door 220 may rotate around the first axis 222 in the clockwise direction.

Figure 6:
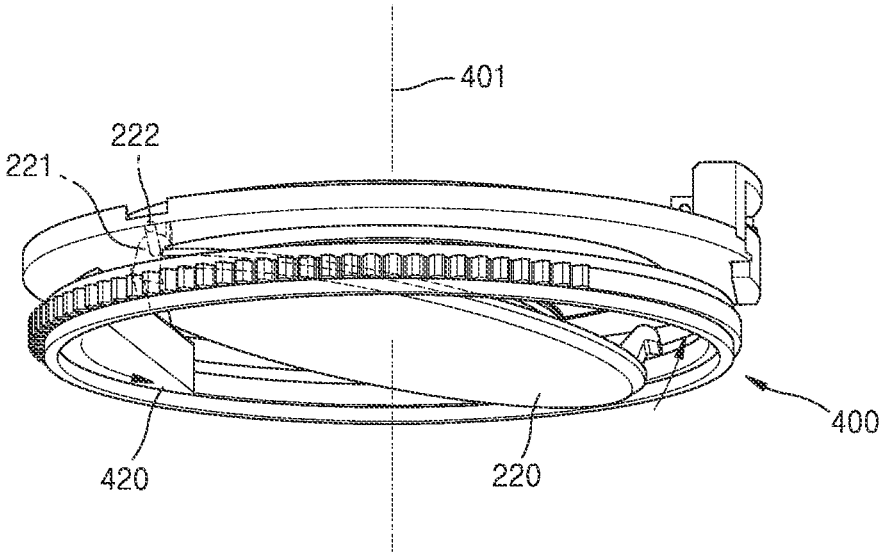
FIG. 6 is a perspective view of a pressurizer and a dust collecting container door according to an embodiment of the disclosure.
Figure 7:
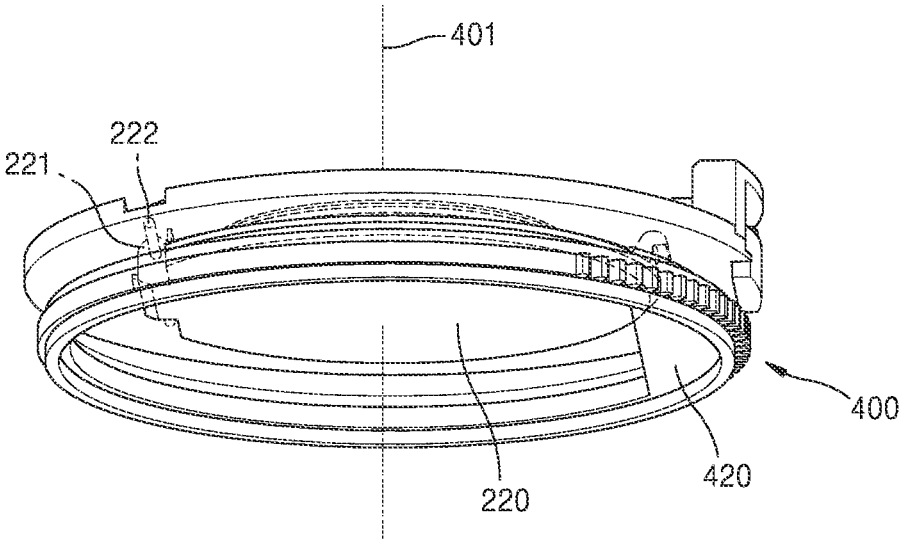
FIG. 7 is a perspective view of a pressurizer and a dust collecting container door according to an embodiment of the disclosure.

FIG. 6 is a perspective view of a pressurizer and a dust collecting container door according to an embodiment. FIG. 7 is a perspective view of a pressurizer and a dust collecting container door according to an embodiment.

With reference to FIGS. 3D and 6, when the state of the dust collecting container door 220 is switched from the open state to the close state according to an embodiment of the disclosure, the first driving motor 530 may be operated to generate power. The power generated by the first driving motor 530 may be transmitted to the pressurizer 400 by using the power transfer member 550. For example, the power transfer member 550 may be arranged between the first driving motor 530 and the gear portion 440 and transmit the power generated by the first driving motor 530 to the gear portion 440.

When the state of the dust collecting container door 220 is automatically switched from the open state to the close state, the pressurizer 400 may receive the power generated by the first driving motor 530 and rotate around the second axis 401. When the state of the dust collecting container door 220 is automatically switched from the open state where the first opening 211 is opened to the close state where the first opening 211 is closed, the pressurizer 400 may rotate around the second axis 401 in the counterclockwise direction as illustrated in FIG. 6. At this time, the stepped portion 420 included in the pressurizer 400 may also rotate along the second axis 401 to be apart from the hinge portion 221. As the stepped portion 420 rotates along the second axis 401 to be apart from the hinge portion 221, one side of the stepped portion 420 may be in contact with one side of the dust collecting container door 220 and apply pressure thereon. Accordingly, the dust collecting container door 220 may rotate around the first axis 222 in the counterclockwise direction. In this manner, the state of the dust collecting container door 220 may be automatically switched from the open state to the close state.

With reference to FIG. 7, the pressurizer 400 according to an embodiment may further rotate around the second axis 401 in the counterclockwise direction in comparison with the pressurizer 400 illustrated in FIG. 6. At this time, the stepped portion 420 included in the pressurizer 400 may also additionally rotate along the second axis 401 to be apart from the hinge portion 221. As the stepped portion 420 rotates additionally along the second axis 401 to be apart from the hinge portion 221, one side of the stepped portion 420 may be in contact with one side of the dust collecting container door 220 and apply additional pressure thereon. Accordingly, the dust collecting container door 220 may additionally rotate around the first axis 222 in the counterclockwise direction to close the first opening 211. In this manner, the state of the dust collecting container door 220 may be automatically switched from the open state to the close state.

Figure 8:
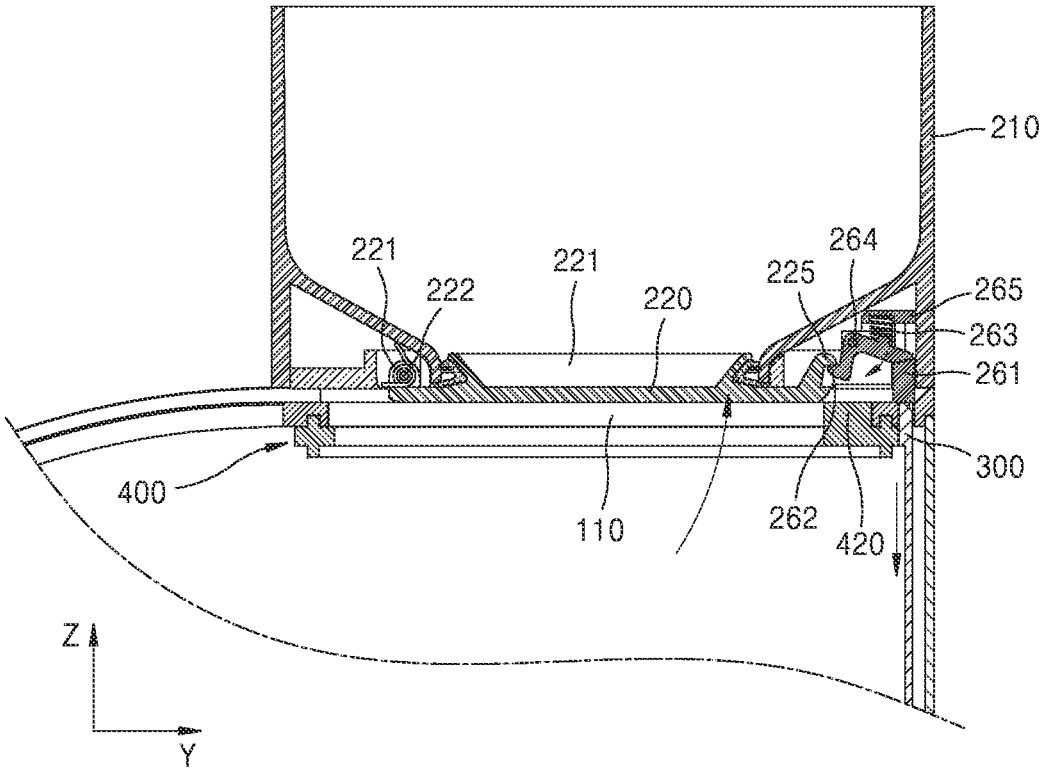
FIG. 8 is a partial cross-sectional view of a cleaning device in a state where a dust collecting container door has closed a first opening, according to an embodiment of the disclosure.

FIG. 8 is a partial cross-sectional view of a cleaning device in a state where a dust collecting container door has closed a first opening according to an embodiment.

With reference to FIGS. 3C and 8, when the dust collecting container door 220 closes the first opening 211, according to an embodiment of the disclosure, a processor (not shown) may apply a control signal to the second driving motor 350 to generate power. For example, the power generated by the second driving motor 350 may be transmitted to the locking controller 300 through the 2-1 power transfer gear 360 and the 2-2 power transfer gear 370. According to an embodiment of the disclosure, when the locking controller 300 which has received the power descends in one direction (Z direction), the pressure applied on the rotational force applying portion 261 from the locking controller 300 may be released. At this time, the elastic portion 263 may be expanded, and by the elastic force applied from the elastic portion 263, the rotational force applying portion 261 may descend in one direction (Z direction).

As the rotational force applying portion 261 descends in one direction (Z direction), the second latch portion 262 supported by the rotational force applying portion 261 may rotate around the rotation shaft 264 in the clockwise direction. Accordingly, the first latch portion 225 may be engaged with the second latch portion 262 and the unlock state may be switched to the lock state. At this time, one side of the stepped portion 420 included in the pressurizer 400 may stay in contact with one side of the dust collecting container door 220.

According to another embodiment of the disclosure, the locking controller 300 which has received the power may descend in advance in one direction (Z direction). At this time, the second latch portion 262 may rotate around the rotation shaft 264 in the clockwise direction and return to an initial position. According to an embodiment of the disclosure, when the first latch portion 225 rotates along with the dust collecting container door 220, the first latch portion 225 may overcome the elastic force applied from the elastic portion 263 and be engaged with the second latch portion 262. Accordingly, the unlock state of the first latch portion 225 and the second latch portion 262 may be switched to the lock state.

Figure 9A:
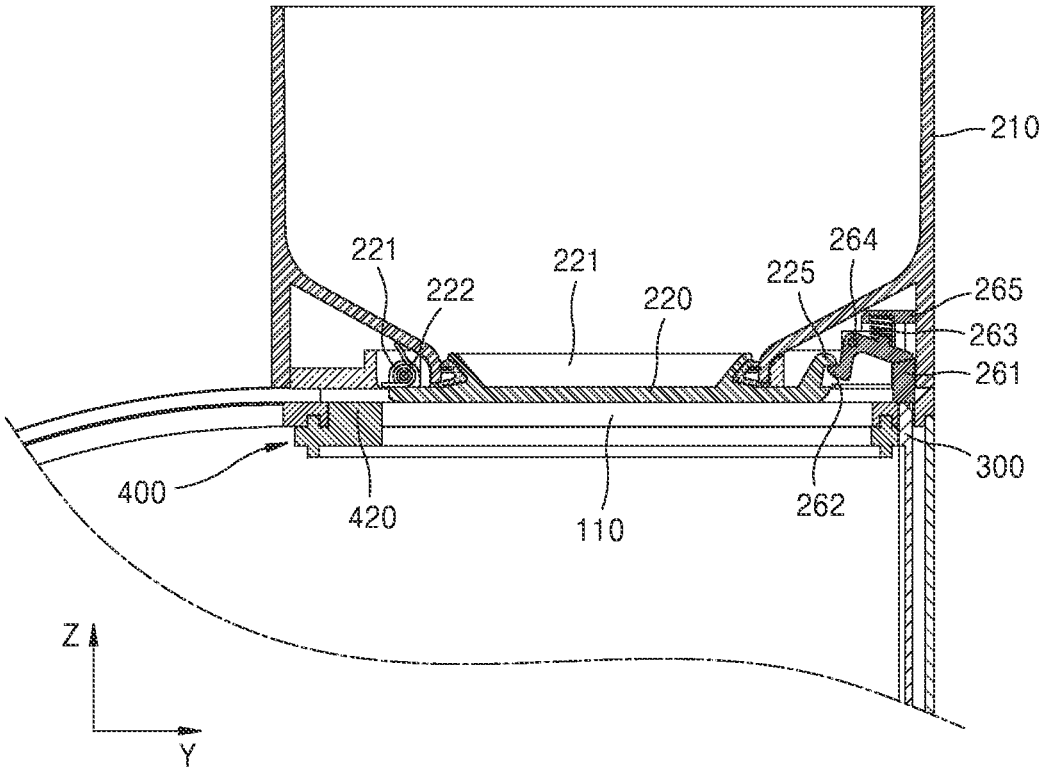
FIG. 9A is a partial cross-sectional view of a cleaning device in a state where a dust collecting container door has closed a first opening, according to an embodiment of the disclosure.
Figure 9B:
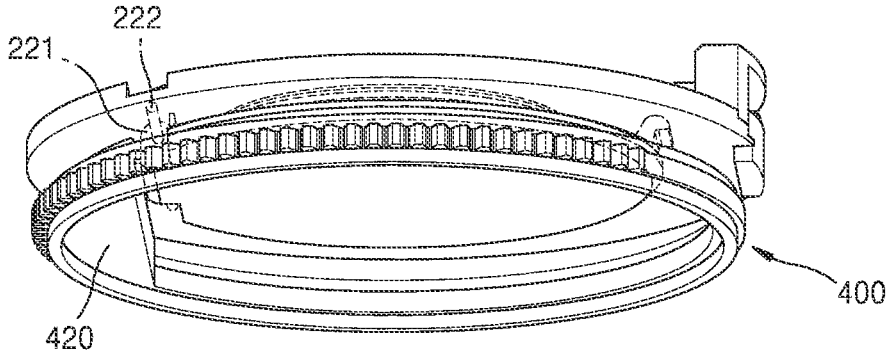
FIG. 9B is a perspective view of a pressurizer and a dust collecting container door according to an embodiment of the disclosure.

FIG. 9A is a partial cross-sectional view of a cleaning device in a state where a dust collecting container door has closed a first opening according to an embodiment. FIG. 9B is a perspective view of a pressurizer and a dust collecting container door according to an embodiment.

With reference to FIGS. 3D, 9A, and 9B, when the state of the first latch portion 225 and the second latch portion 262 is switched from the unlock state to the lock state, a processor (not shown) may apply a control signal to the first driving motor 530 to generate power. The pressurizer 400 according to an embodiment may receive the power generated by the first driving motor 530 and rotate around the second axis 401. For example, the pressurizer 400 may rotate around the second axis 401 in the clockwise direction. At this time, the stepped portion 420 included in the pressurizer 400 may also rotate along the second axis 401 to be adjacent to the hinge portion 221. As the stepped portion 420 rotates around the second axis 401 to be adjacent to the hinge portion 221, one side of the stepped portion 420 may not be in contact with one side of the dust collecting container door 220. That is, when the dust collecting container door 220 closes the first opening 211, and the mutual locking between the first latch portion 225 and the second latch portion 262 is maintained, one side of the stepped portion 420 included in the pressurizer 400 may be arranged not to be in contact with one side of the dust collecting container door 220. The pressurizer 400 may rotate around the second axis 401 until the stepped portion 420 is placed under the hinge portion 221 as illustrated in FIG. 9B.

The embodiments described above are provided merely as an example and a person skilled in the art may be able to make modifications and equivalent embodiments from the embodiments of the disclosure. Accordingly, the true scope of the technical protection of the disclosure should be defined by the technical ideas described in the following scope of claims.

What is claimed is:

1. A cleaning device comprising: a vacuum cleaner including a dust collecting container to collect foreign substances therein; and a dust collecting station connectable to the dust collecting container, and to receive the collected foreign substances from the dust collecting container, wherein the dust collecting container includes:

a dust collecting container main body including a first opening; and a dust collecting container door configured to open or close the first opening by rotating around a first axis in a clockwise direction or in a counterclockwise direction; and a door latch to lock or unlock the dust collecting container door, wherein the dust collecting station includes:

a station main body including: an accommodation space formed therein to store the received foreign substances;

a capturing portion formed on one side of the station main body, the capturing portion including a second opening to intercommunicate with the first opening of the dust collecting container main body in response to connecting the dust collecting container with the dust collecting station, and configured to capture the foreign substances collected in the dust collecting container;

a pressurizer having a hollow opening to face the second opening, and rotatable around a second axis, which is perpendicular to the first axis, to close the dust collecting container door, the pressurizer including: a base portion having the hollow opening and rotatable around the second axis; and a stepped portion protruded from one side of the base portion toward a center of the hollow opening to cover a part of the hollow opening, and rotatable to make contact with the dust collecting container door to close the first opening; and a processor configured to:

in response to receiving a user input to discharge the foreign substances collected in the dust collecting container to the dust collecting station, unlock the door latch of the dust collecting container so that the dust collecting container door opens the first opening and a part of the dust collecting container door enters into the accommodation space of the station main body through the second opening and the hollow opening thereby intercommunicating the first opening with the second opening to start the discharging of the foreign substances from the dust collecting container to the accommodation space of the station main body;

in response to finish the discharging of the foreign substances, control the pressurizer to rotate around the second axis so that the stepped portion makes contact with the dust collecting container door to push the dust collecting container door to rotate around the first axis to close the first opening, and the door latch locks the dust collecting container door; and in response to closing the first opening by the dust collecting container door and locking the dust collecting container door by the door latch, control the pressurizer to rotate back to an original state which the pressurizer is not in contact with an exterior side of the dust collecting container door.

2. The base portion has a shape of a ring; and

The stepped portion has a circular segment shape and protrudes from the one side of the base portion in a direction toward the second axis and extending along an angle in a circumferential direction of the base portion, and wherein one side of the stepped portion is arranged to face the exterior side of the dust collecting container door.

3. The cleaning device of claim 2, wherein, in response to closing the first opening by the dust collecting container door, the one side of the stepped portion is arranged to be in contact with the exterior side of the dust collecting container door, and in response to opening the first opening by the dust collecting container door, the one side of the stepped portion is arranged not to be in contact with the exterior side of the dust collecting container door.

4. The cleaning device of claim 1, further comprising a first driving motor configured to apply power to the pressurizer to rotate around the second axis.

5. The cleaning device of claim 1, further comprising:

a locking controller having a main body;

an accommodating portion to accommodate the main body of the locking controller in an unlock state of the dust collecting container door, wherein the main body of the locking controller is protruded from the accommodating portion in a lock state of the dust collecting container door, the locking controller is configured to switch the dust collecting container door between the lock state which the locking controller locks the dust collecting container door by applying pressure to the door latch arranged at the dust collecting container and the unlock state which the locking controller unlocks the dust collecting container door by releasing the applied pressure to the door latch.

6. The cleaning device of claim 5, wherein, in response to closing the first opening by the dust collecting container door and switching to the lock state by the locking controller, the one side of the stepped portion is arranged not to be in contact with the exterior side of the dust collecting container door.

7. The cleaning device of claim 5, further comprising a second driving motor configured to apply power to the locking controller to be protruded from the accommodating portion or to be accommodated in the accommodating portion.

8. The cleaning device of claim 1, further comprising an intake fan configured to form an intake current so that the foreign substances in the dust collecting container are captured in the capturing portion, wherein, by the intake current, the dust collecting container door is further configured to rotate around the first axis in the clockwise direction or in the counter-clockwise direction to open the first opening arranged at the dust collecting container main body.

9. The cleaning device of claim 1, further comprising an elastic spring configured to apply elastic force to the dust collecting container door to close the first opening arranged at the dust collecting container main body.

10. The cleaning device of claim 9, wherein the elastic spring is a torsion spring arranged on the first axis.

11. The cleaning device of claim 2, further comprising a hinge portion connecting the dust collecting container main body to the dust collecting container door, wherein the stepped portion rotates along the second axis to be adjacent to the hinge portion in response to the dust collecting container door being in an open state to open the first opening, and the stepped portion rotates along the second axis to be apart from the hinge portion in response to the dust collecting container door being in a close state to close the first opening.

12. The cleaning device of claim 4, further comprising a power transfer gear configured to transmit the power generated by the first driving motor to the pressurizer.

13. A dust collecting station connectible to a dust collecting container of a vacuum cleaner to receive foreign substances collected in the dust collecting container from the dust collecting container, the dust collecting station comprising: a station main body including:

an accommodation space formed therein to store the received foreign substances;

a capturing portion formed on one side of the station main body, the capturing portion including a second opening to intercommunicate with a first opening of a dust collecting container main body in response to connecting the dust collecting container with the dust collecting station, and configured to capture the foreign substances collected in the dust collecting container; and;

a pressurizer having a hollow opening to face the second opening, and rotatable around a second axis, which is perpendicular to a first axis, to close a dust collecting container door of the dust collecting container, the pressurizer including:

a base portion having the hollow opening and rotatable around the second axis; and a stepped portion protruded from one side of the base portion toward a center of the hollow opening to cover a part of the hollow opening, and rotatable to make contact with the dust collecting container door to close the first opening;

and a processor configured to:

in response to receiving a user input to discharge the foreign substances collected in the dust collecting container to the dust collecting station, unlock a door latch of the dust collecting container so that the dust collecting container door opens the first opening and a part of the dust collecting container door enters into the accommodation space of the station main body through the second opening and the hollow opening thereby intercommunicating the first opening with the second opening to start the discharging of the foreign substances from the dust collecting container to the accommodation space of the station main body;

in response to finishing the discharging of the foreign substances, control the pressurizer to rotate around the second axis so that the stepped portion makes contact with the dust collecting container door to push the dust collecting container door to rotate around the first axis to close the first opening, and the door latch locks the dust collecting container; and in response to closing the first opening by the dust collecting container door and locking the dust collecting container door by the door latch, control the pressurizer to rotate back to an original state which the pressurizer is not in contact with an exterior side of the dust collecting container door.

14. The dust collecting station of claim 13, wherein:

the base portion has a ring shape; and the stepped portion has a circular segment shape, and protrudes from the one side of the base portion in a direction toward the second axis and extending along in a circumferential direction of the base portion, and wherein one side of the stepped portion is arranged to face the exterior side of the dust collecting container door.

15. The dust collecting station of claim 14, wherein, in response to closing the first opening by the dust collecting container door, the one side of the stepped portion is arranged to be in contact with the exterior side of the dust collecting container door, and in response to opening the first opening by the dust collecting container door, the one side of the stepped portion is arranged not to be in contact with the one side of the exterior dust collecting container door.

16. The dust collecting station of claim 13, further comprising a first driving motor configured to apply power to the pressurizer to rotate around the second axis.

17. The dust collecting station of claim 13, further comprising:

a locking controller having a main body;

an accommodating portion to accommodate the main body of the locking controller in an unlock state of the dust collecting container door, wherein the main body of the locking controller is protruded from the accommodating portion in a lock state of the dust collecting container door, and the locking controller is configured to switch the dust collecting container door between the lock state which the locking controller locks the dust collecting container door by applying pressure to the door latch arranged at the dust collecting container and the unlock state which the locking controller unlocks the dust collecting container door by releasing the applied pressure from the door latch.

18. The dust collecting station of claim 17, further comprising a second driving motor configured to apply power to the locking controller to be protruded from the accommodating portion or to be accommodated in the accommodating portion.

* * * * *